US008813525B2

(12) United States Patent
Ayers et al.

(10) Patent No.: US 8,813,525 B2
(45) Date of Patent: Aug. 26, 2014

(54) REVESIBLE GARMENT WITH WARMING SIDE AND COOLING SIDE

(75) Inventors: David Ayers, Baltimore, MD (US); Kelly Cortina, Severn, MD (US); Craig Lindemann, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 1106 days.

(21) Appl. No.: 12/776,460

(22) Filed: May 10, 2010

(65) Prior Publication Data

US 2011/0088137 A1 Apr. 21, 2011

Related U.S. Application Data

(60) Provisional application No. 61/253,696, filed on Oct. 21, 2009.

(51) Int. Cl.

| | |
|---|---|
| ***D04B 1/12*** | (2006.01) |
| ***A41D 15/00*** | (2006.01) |
| ***A42B 1/20*** | (2006.01) |
| ***D04B 1/24*** | (2006.01) |
| *A41D 13/00* | (2006.01) |

(52) U.S. Cl.

CPC ..... *A41D 15/005* (2013.01); *A42B 1/206* (2013.01); *A41B 2400/60* (2013.01); *A41D 13/0015* (2013.01); *A41D 2400/10* (2013.01); *D04B 1/24* (2013.01)

USPC ..... 66/194; 66/196

(58) Field of Classification Search

CPC ..... D10B 2403/0111; D10B 2403/0112; D04B 1/24; D04B 1/02; D04B 1/025; D04B 21/02; D04B 21/207; A41D 15/005; A41D 2400/60; A41D 13/0015; A41D 2400/10

USPC ..... 66/169 R, 170, 171, 191, 192, 194, 196

See application file for complete search history.

(56) References Cited

U.S. PATENT DOCUMENTS

| | | | | | |
|---|---|---|---|---|---|
| 3,971,234 | A | * | 7/1976 | Taylor | 66/200 |
| 4,043,151 | A | * | 8/1977 | Schmidt | 66/9 R |
| 4,267,710 | A | * | 5/1981 | Imamichi | 66/196 |
| 4,353,229 | A | * | 10/1982 | Hutchinson et al. | 66/197 |
| 4,881,383 | A | * | 11/1989 | Spillane et al. | 66/194 |
| 5,528,910 | A | * | 6/1996 | Azais | 66/197 |
| 5,561,860 | A | * | 10/1996 | Nguyen-Senderowicz | 2/90 |
| 5,855,125 | A | * | 1/1999 | Lohmueller et al. | 66/196 |
| 5,916,273 | A | * | 6/1999 | Hepfinger | 66/194 |
| 6,006,550 | A | * | 12/1999 | Singh | 66/13 |
| 6,089,194 | A | | 7/2000 | LaBelle | |
| 6,105,401 | A | * | 8/2000 | Chadeyron et al. | 66/195 |
| 6,116,059 | A | * | 9/2000 | Rock et al. | 66/191 |
| 6,131,419 | A | * | 10/2000 | Rock et al. | 66/194 |
| 6,196,032 | B1 | * | 3/2001 | Rock et al. | 66/195 |
| 6,199,410 | B1 | * | 3/2001 | Rock et al. | 66/195 |
| 6,427,493 | B1 | * | 8/2002 | Kasdan et al. | 66/169 R |
| 6,526,783 | B2 | * | 3/2003 | Sheu | 66/22 |
| 6,622,528 | B2 | * | 9/2003 | Masse et al. | 66/22 |
| 6,634,190 | B2 | * | 10/2003 | Didier-Laurent | 66/196 |
| 6,647,551 | B2 | * | 11/2003 | Palumbo | 2/69 |
| 7,043,766 | B1 | | 5/2006 | Foreman et al. | |
| 7,428,772 | B2 | * | 9/2008 | Rock | 28/159 |
| 7,437,774 | B2 | | 10/2008 | Baron et al. | |
| 7,707,857 | B1 | * | 5/2010 | McMurray et al. | 66/196 |
| 7,788,953 | B1 | * | 9/2010 | McMurray et al. | 66/196 |
| 8,336,117 | B2 | * | 12/2012 | Carter et al. | 2/87 |
| 2003/0126894 | A1 | * | 7/2003 | Masse et al. | 66/196 |
| 2004/0237599 | A1 | * | 12/2004 | Kondou et al. | 66/202 |
| 2005/0112976 | A1 | * | 5/2005 | McMurray et al. | 442/306 |
| 2006/0277950 | A1 | * | 12/2006 | Rock | 66/169 R |
| 2007/0093162 | A1 | * | 4/2007 | Holcombe et al. | 442/208 |
| 2007/0094762 | A1 | * | 5/2007 | Carter et al. | 2/69 |
| 2008/0070477 | A1 | | 3/2008 | Barbour et al. | |
| 2008/0163650 | A1 | * | 7/2008 | Sytz | 66/194 |
| 2011/0016602 | A1 | * | 1/2011 | Berns et al. | 2/69 |
| 2011/0119811 | A1 | * | 5/2011 | Rock et al. | 2/243.1 |
| 2013/0074240 | A1 | * | 3/2013 | Carter et al. | 2/69 |
| 2013/0196109 | A1 | * | 8/2013 | Rock et al. | 428/76 |

FOREIGN PATENT DOCUMENTS

| | | | | |
|---|---|---|---|---|
| JP | 2000256945 | A | * | 9/2000 |
| WO | WO 0200980 | A1 | * | 1/2002 |

* cited by examiner

*Primary Examiner* — Danny Worrell

(57) ABSTRACT

A reversible garment with a warming side and a cooling side is comprised of a double knit fabric including a first face and a second face. The garment is reversible such that either face may be worn on the exterior of the garment. When the first side of the garment is worn against the body, the garment provides a heating effect by trapping air and body heat while wicking moisture to the outside of the fabric. When the second side of the garment is worn against the body, the garment provides a cooling garment by accelerating moisture movement across the fabric. Indicia are provided on the garment to indicate whether heating or cooling effects will be provided in the first-side-out configuration and the second-side-out configuration.

12 Claims, 4 Drawing Sheets

REVESIBLE GARMENT WITH WARMING SIDE AND COOLING SIDE

BACKGROUND

This disclosure relates to the field of textiles and particularly to athletic garments capable of providing cooling and/or insulating effects.

Athletes participating in sporting activities are often exposed to changing weather conditions. For example, an athlete may start an activity exposed to relatively cold conditions. Those conditions may then change during the activity, causing the athlete to be exposed to relatively warm conditions at a later time. In these situations, it is typical for the athlete to change his or her shirt or other garment to adapt to the changing weather conditions.

When an athlete wishes to change his or her shirt in the middle of a sporting activity, he or she must bring along a second shirt in addition to the shirt he or she is wearing at the start of the activity. However, carrying a second shirt is inconvenient. Furthermore, even if the athlete does not carry the shirt at all times, the shirt must be placed in a location where it can be easily accessed. Unfortunately, depending on the activity, this may be impossible. Also, it may be difficult or time consuming to reach the second shirt when the athlete decides to make a change. Specifically, the desired garment may be located at a distance from the athlete, making the change in garments inconvenient or completely impossible. For example, a runner may find that he prefers a warmer garment five miles into a ten mile run, after the runner is too far from his or her wardrobe to conveniently make a change to a different garment.

Accordingly, it would be desirable to provide a garment that has the ability to selectively provide cooling effects or warming effects to the wearer. It would also be desirable for the wearer to easily determine whether the garment is configured to provide such cooling effects or warming effects. Furthermore, it would be desirable for such a garment to be lightweight and fashionable, allowing the wearer to freely wear the garment in either the warming configuration or the cooling configuration.

SUMMARY

In at least one embodiment, a reversible garment is comprised of a dual faced fabric including a first face and a second face that is opposite the first face. The first face of the fabric provides a textured surface. The textured surface may be provided in various manners, such as, for example, using a yarn comprised of textured filaments. In addition, the textured surface may be provided using a patterned knit construction, such as a patterned jacquard structure. The second face of the fabric provides a smooth surface. The smooth surface of the fabric may also be provided in various manners, such as, for example, using a yarn comprised of "flat" filaments. In addition, the smooth surface may be provided by a knit construction that provides a generally smooth surface, such as a jersey knit construction.

The first face and the second face of the garment are connected to provide a unified dual face fabric. For example, the first face and the second face of the garment may be provided by a double-knit fabric. Other examples of fabrics that may be used to provide the differing first and second faces of the reversible garment include bonded fabric constructions and plated fabric constructions.

The garment is arranged such that the first face covers the majority of one side of the garment (e.g., the inside) and the second fabric face covers the majority of the opposite side (e.g., the outside). The garment is reversible such that either side may be worn on the exterior of the garment. When the first face of the garment (i.e., the textured knit surface) is worn against the body, the garment provides a heating effect by trapping air and body heat while wicking moisture to the outside of the fabric. When the second face of the garment (i.e., the smooth knit surface) is worn against the body, the garment provides a cooling effect by accelerating lateral moisture movement across the fabric.

In at least one embodiment, the garment includes indicia on the first fabric face to indicate whether the current configuration of the garment will provide a heating effect or a cooling effect. For example, the garment may include text or other symbols near the cuff or collar that indicates that the garment will provide a heating effect when that side of the garment is exposed. The reverse side of the garment would then include text or other symbols indicating that the garment will provide a heating effect when that side of the garment is exposed.

In at least one embodiment, the reversible garment is a long sleeved shirt having finished seams, including finished seams around the openings in the garment on both the outside and the inside of the garment. In particular, the reversible garment may include a collar, cuffs, and a torso opening. These openings are all associated with a finished stitched seam such that no edge portion remains loose or exposed around such openings on either side of the garment. Accordingly the garment has a finished appearance on both a first side of the garment associated with the first fabric face and a second opposite side of the garment associated with the second fabric face. This finished appearance on both sides of the garment allows the garment to be used in a reversible manner with either the first fabric face exposed or the second fabric face exposed.

The above described features and advantages, as well as others, will become more readily apparent to those of ordinary skill in the art by reference to the following detailed description and accompanying drawings. While it would be desirable to provide a garment that provides one or more of these or other advantageous features as may be apparent to those reviewing this disclosure, the teachings disclosed herein extend to those embodiments which fall within the scope of any appended claims, regardless of whether they include or accomplish one or more of the advantages or features mentioned herein.

DESCRIPTION

Figure 1:
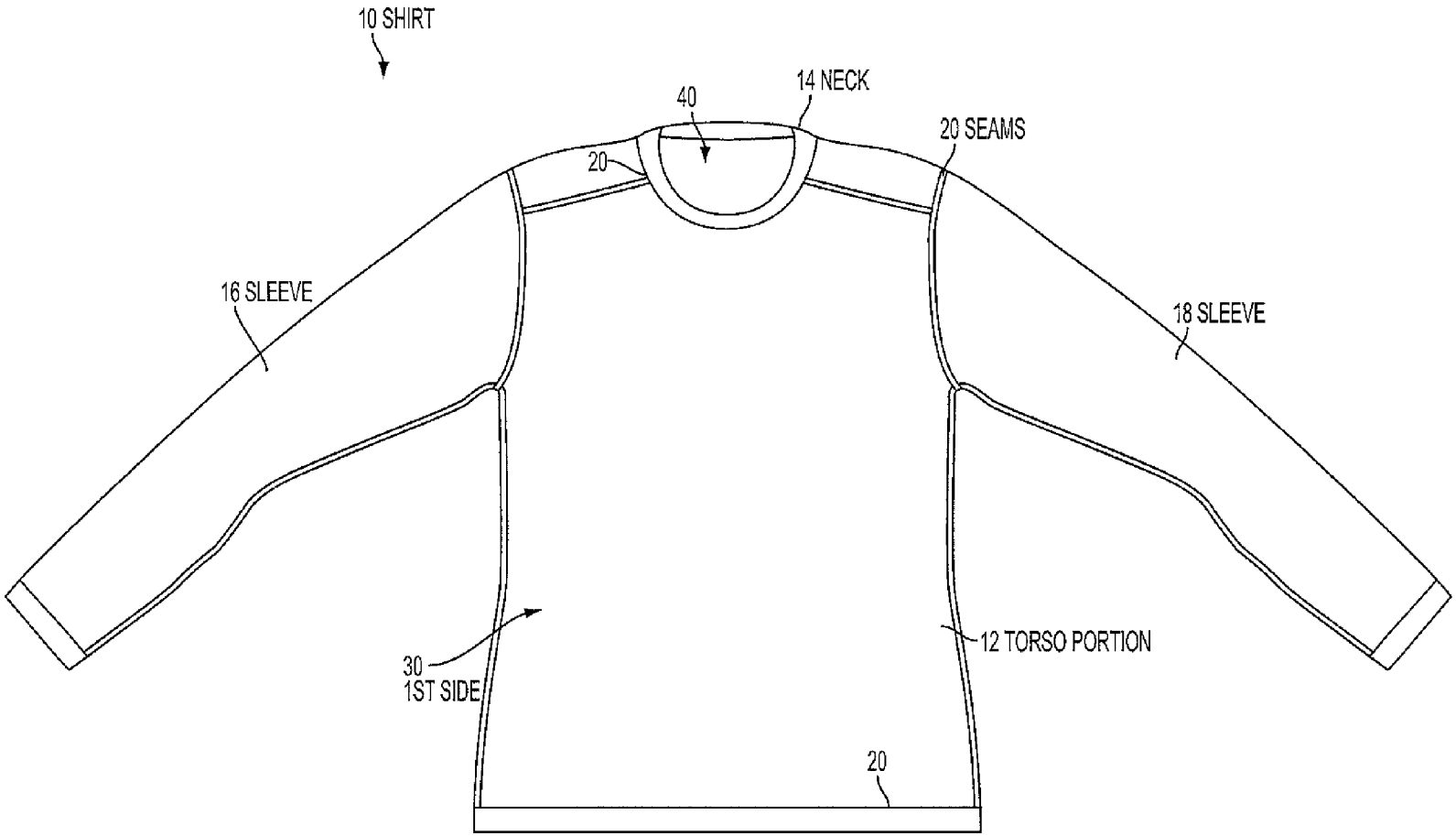
FIG. 1 shows a first side of a reversible long sleeve garment having a warming side and a cooling side.

With reference to FIG. 1, a reversible long sleeve garment having a warming side and a cooling side is shown. In the embodiment of FIG. 1, the garment is a reversible long sleeved shirt 10. However, it will be recognized that in other embodiments the garment may take on other forms, including, for example, pants, a short sleeved shirt, a vest, or a hat. In the embodiment of FIG. 1, the shirt 10 includes a torso portion 12, a neck 14, and two sleeves, 16 and 18. The shirt 10 also includes a plurality of seams 20 that connect various fabric segments of the garment.

Figure 2:
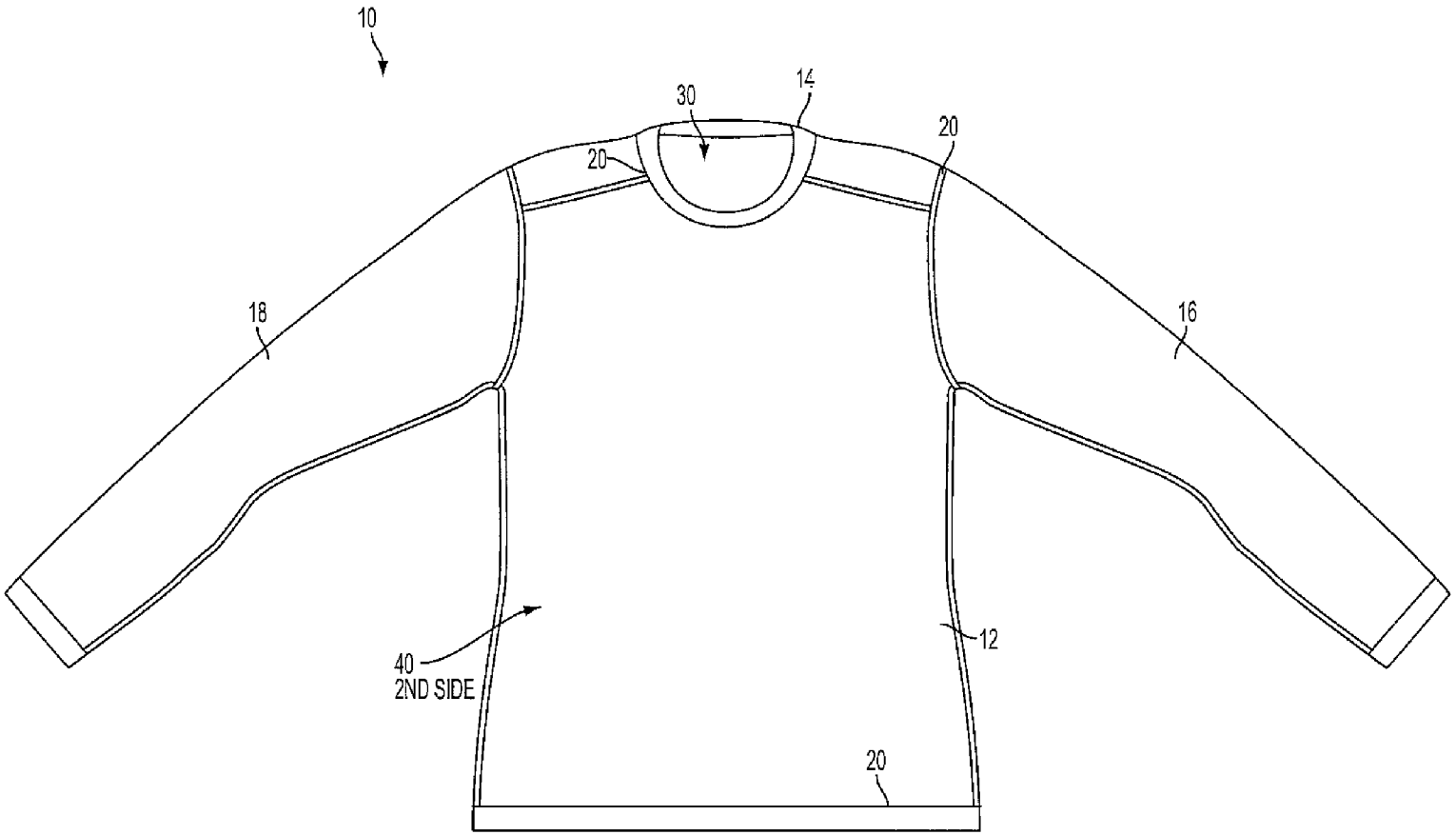
FIG. 2 shows a second opposite side of a reversible long sleeve garment having a warming side and a cooling side.
Figure 3:
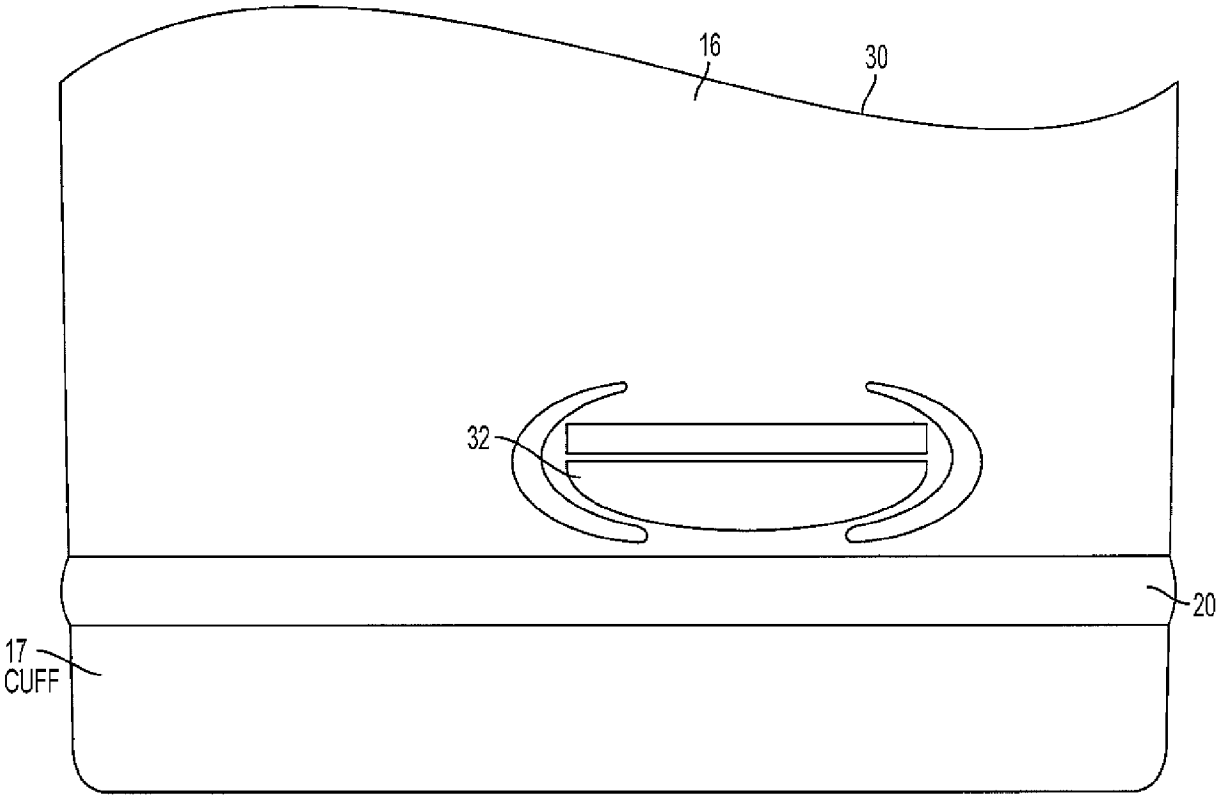
FIG. 3 shows an indicia on the reversible long sleeve garment indicating that the garment provides cooling effects when worn in the configuration of FIG. 1.
Figure 4:
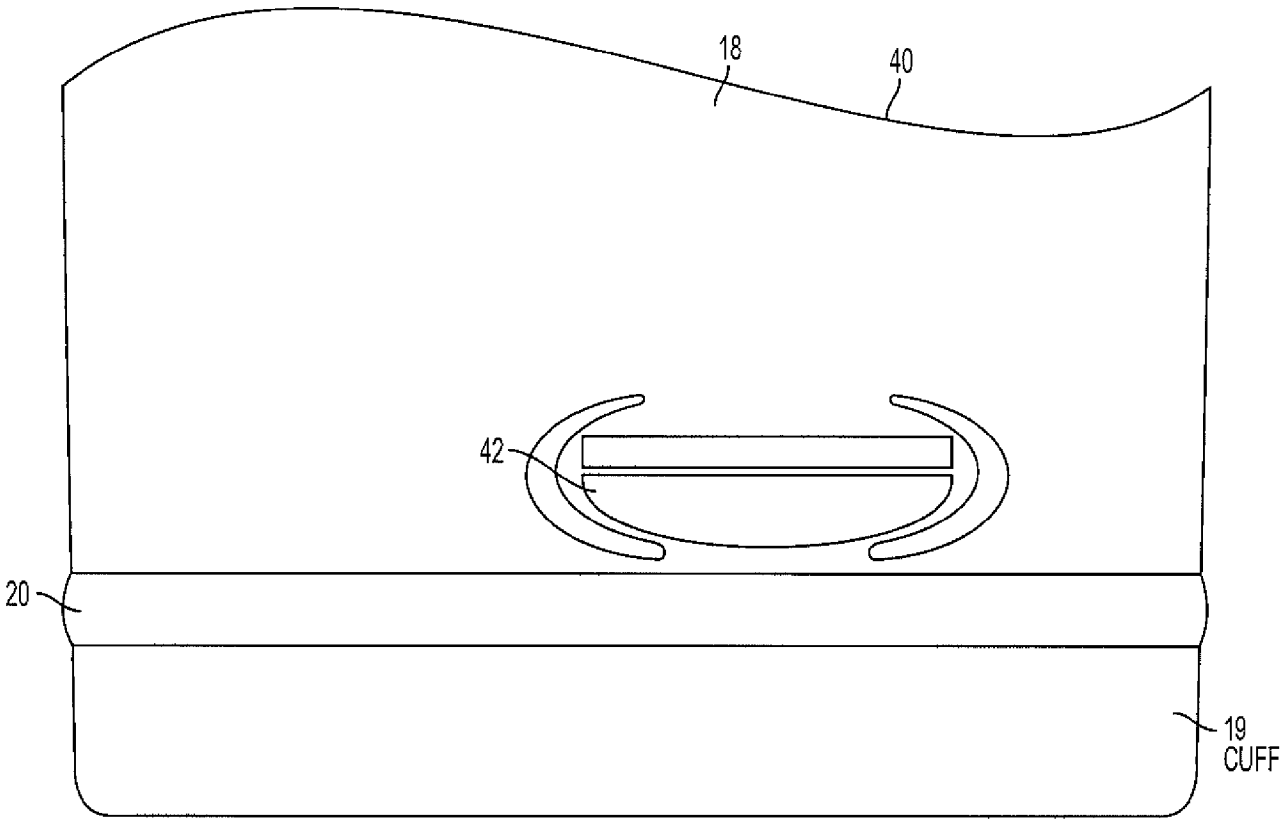
FIG. 4 shows indicia on the reversible long sleeve garment indicating that the garment provides warming effects when worn in the configuration of FIG. 2.

One side 30 of the shirt 10 is shown in FIG. 1 and the opposite, reverse side 40 (i.e., inside-out side) of the shirt 10 is shown in FIG. 2. Like the first side 30, the reverse side 40 of the shirt also includes the torso portion 12, the neck 14, two sleeves, 16 and 18, cuffs 17 and 19 and a plurality of seams 20 that connect various fabric segments of the garment. In the embodiment of FIGS. 1 and 2, the seams are finished on both sides 30 and 40 of the shirt 10, giving the shirt a neat, finished appearance, regardless of whether the shirt is worn in a first orientation/configuration (such as that of FIG. 1) or a reverse, inside-out configuration (such as that of FIG. 2). Exemplary stitching around the cuffs 17 and 19 on both sides 30 and 40 of the garment is shown in FIGS. 3 and 4. This stitching allows the garment to be worn in either configuration with an unfinished/inside-out appearance in either configuration.

The shirt 10 is comprised of a fabric construction that provides two opposing fabric sides 30, 40 having different characteristics. The opposing fabric sides may be unified such that the two sides 30, 40 do not move independent of each other.

In at least one embodiment, the fabric construction for the shirt 10 is a double-knit fabric construction. The nature of the double-knit fabric is such that it provides warming effects when the garment 10 is worn one way and cooling effects when the garment 10 is worn the other way (i.e., in the reverse configuration). The double knit fabric has two distinct face characteristics. The face 30 of the fabric shown in FIG. 1 has a textured knit surface. When this face 30 is worn on the inside against the body, the fabric traps air and body heat while wicking moisture to the outside of the fabric. The effect is a micro-climate of warm, dry air against the body, keeping the body warm.

The opposite face 40 of the fabric, which is shown in FIG. 2, has a smooth face. When this face 40 is worn on the inside, against the body, the fabric serves as a second skin, eliminating/reducing air gaps and enhancing the evaporative cooling of the body by accelerating lateral moisture movement across the fabric. With minimal/few air gaps, the drying of this moisture is felt on the skin causing an enhanced cooling effect.

In at least one embodiment, the fabric used to provide the faces 30 and 40 of FIGS. 1 and 2 is a double-knit fabric comprised of a polyester/elastane blend. The polyester/elastane blend may be provided by elastane filaments and a combination of flat and textured polyester yarns. For example, the fabric may comprise 5% elastane and 95% polyester yarns. The polyester yarns are knit together such that the first side 30 is comprised primarily of textured polyester yarns provided in a patterned knit construction (e.g., a jacquard knit). The first side 30 presents a textured surface to the wearer which provides a warming effect. The second side 40 of the double-knit fabric is comprised primarily of flat polyester yarns knit in a jersey knit (or other knit providing at least one smooth side). The smooth side of the jersey knit construction is presented as the second face 40 that provides a cooling effect. Accordingly, in at least one embodiment, the combination of yarns work together in a system that wicks moisture to either cool the wearer, or keep the wearer warm and dry, depending on the manner of wear.

With reference now to FIGS. 3 and 4, the shirt includes indicia on each fabric face to indicate whether warming or cooling effects will be provided with the shirt in a particular configuration. For example, in the embodiment of FIG. 3, textual markings in the form of indicia 32 are provided on the end of the sleeve 16 just above the cuff 17. The indicia 32 indicate that when the face 30 of the garment is worn on the outside, the shirt 10 will provide cooling effects to the wearer. The indicia 32 are permanently secured to the shirt 10 by silk-screen, embroidery, or any other appropriate method, such that the indicia 32 will remain on the shirt for the life of the shirt.

FIG. 4 shows similar textual markings/indicia 42 on the end of the sleeve 18 just above the cuff 19. The indicia 42 indicate that when the face 40 of the garment is worn on the outside, the shirt 10 will provide warming effects to the wearer. Although the indicia 32 and 42 has been shown as textual indicia in FIGS. 3 and 4, it will be recognized that any of numerous other indicia may be utilized on the garment to indicate which garment configuration will provide warming or cooling effects. For example, icons, colors, or other indicia may be used to indicate the proper configuration for warming or cooling effects. Furthermore, in one embodiment, the indicia could take the simple form of different colors on opposing faces of the garment. For example, the indicia may include a blue color on one side to indicate cooling effects, and a red color on the opposite side to indicate warming effects.

In operation, the wearer simply uses the indicia on the shirt 10 to configure the shirt to provide cooling effects or warming effects. In particular, if cooling effects are desired, the shirt is configured with the cooling indicia on the outside. If warming effects are desired, the shirt is configured with the warming indicia on the outside. Because the shirt 10 may be worn in either configuration (inside out or vice-versa), the shirt provides the wearer with the ability to instantly adjust to his or her climate or conditions by choosing the side of the fabric he or she wears against the skin. Normally an athlete would need two different shirts to achieve this.

Although the present invention has been described with respect to certain preferred embodiments, it will be appreciated by those of skill in the art that other implementations and adaptations are possible. For example, although a double knit fabric has been disclosed as one possible fabric construction capable of providing the dual faced fabric for the reversible garment disclosed herein, various other fabric constructions are also possible, including, for example, bonded or plated fabric constructions. Moreover, there are advantages to individual advancements described herein that may be obtained without incorporating other aspects described above. Therefore, the spirit and scope of any appended claims should not be limited to the description of the preferred embodiments contained herein.

We claim:

1. A reversible garment comprising:

a united fabric having:

a first, cooling side formed of flat yarns operable to move moisture from a wearer's skin laterally across the fabric;

a second, warming side formed of textured yarns operable to move moisture from the wearer's skin and wick the moisture outside the fabric;

a first indicator disposed on one of the first fabric side and the second fabric side, the first indicator indicating the cooling side of the fabric is positioned facing the wearer; and a second indicator disposed on the other of the first fabric side and the second fabric side, the second indicator indicating the warming side of the fabric is positioned facing the wearer.

2. The reversible garment according to claim 1, wherein said first and second fabric sides are unified to prevent movement of the first fabric side with respect to the second fabric side.

3. The reversible garment according to claim 1, wherein:

the textured yarn is textured polyester yarn;

the flat yarn is flat polyester yarn; and the fabric further comprises elastane filaments.

4. The reversible garment according to claim 3, wherein the double knit fabric comprises approximately five percent elastane filaments.

5. The reversible garment according to claim 1, wherein said reversible garment has finished seams and is selected from the group consisting of pants, shorts, shirts, socks, hats, and vests.

6. The reversible garment according to claim 1, wherein said reversible garment has finished seams and substantially covers a user's torso when worn.

7. The reversible garment according to claim 1, wherein said reversible garment has finished seams and substantially covers a user's body below a user's waist when worn.

8. The reversible garment according to claim 1, wherein:

the fabric is a double knit fabric;

the first fabric side is a jersey knit fabric;

the second fabric side is a jacquard knit fabric; and the first side is coupled to the second side to prevent movement between the sides.

9. The reversible garment of claim 1, wherein:

the first indicator indicating the cooling side of the fabric is positioned facing the wearer is disposed on the second, warming fabric side; and the second indicator indicating the warming side of the fabric is positioned facing the wearer is disposed on the first, cooling fabric side.

10. The reversible garment of claim 1 wherein the textured yarns and flat yarns cooperate to selectively cool or warm the wearer via moisture wicking, depending upon which fabric side is in contact with the wearer.

11. The reversible garment of claim 1, wherein:

the first fabric side generates evaporative cooling of a wearer when the garment is worn such that the first fabric side faces the wearer; and the second fabric side captures body heat of the wearer when the garment is worn such that the second fabric side faces the wearer.

12. The reversible garment of claim 1, wherein the second side defines a textured face and the first side defines a smooth face.

* * * * *